US005519308A

United States Patent [19]

Gilbert

[11] Patent Number: 5,519,308

[45] Date of Patent: May 21, 1996

[54] ZERO-CURVATURE BAND GAP REFERENCE CELL

[75] Inventor: Barrie Gilbert, Portland, Oreg.

[73] Assignee: Analog Devices, Inc., Norwood, Mass.

[21] Appl. No.: 57,523

[22] Filed: May 3, 1993

[51] Int. Cl.[6] ..... G05F 3/16

[52] U.S. Cl. ..... 323/313

[58] Field of Search ..... 323/313, 315, 323/907

[56] References Cited

U.S. PATENT DOCUMENTS

| | | | |
|---|---|---|---|
| Re. 30,586 | 4/1981 | Brokaw | 323/314 |
| 3,887,863 | 6/1975 | Brokaw | 323/19 |
| 4,319,180 | 3/1982 | Nagano | 323/313 |
| 4,714,872 | 12/1987 | Traa | 323/315 X |
| 4,808,908 | 2/1989 | Lewis et al. | 323/313 |

OTHER PUBLICATIONS

McGlinchey, Gerard Data Acquisition and Conversion, *1982 IEEE International Solid–State Circuits Conference*, pp. 80, 81, 296.

*Primary Examiner*—Matthew V. Nguyen

*Assistant Examiner*—E. Tso

*Attorney, Agent, or Firm*—Marger, Johnson, McCollom & Stolowitz

[57] ABSTRACT

In one band gap reference cell, first and second transistors have the bases thereof coupled together. A first supply voltage line is operatively connected to the collectors of the transistors and a second supply voltage line is operatively connected to the emitters of the transistors. The voltage supply lines produce a current proportional to temperature when the device is operating. A first resistor is connected between the emitter of one of the transistors and the second supply line. A third transistor has the base thereof coupled to the bases of the first and second transistors. A current is established in a curve-compensation resistor which is equal to the sum of the currents in the first and second transistors less a nonlinear portion which arises from variations in $V_{BE}$ with respect to temperature. A second resistor is connected across the base-emitter junction of one of the transistors. A current complementary to temperature is established in the resistor when the device is operating. The currents in the transistors and in the resistor are combined to produce a reference current having a predetermined temperature coefficient characteristic. Appropriate selection of resistor values enables providing a reference voltage greater than the band gap voltage.

15 Claims, 6 Drawing Sheets

ZERO-CURVATURE BAND GAP REFERENCE CELL

BACKGROUND OF THE INVENTION

1. Field of the Invention

The present invention relates generally to band gap voltage reference cells and more particularly to such cells which precisely and fundamentally compensate for a nonlinear response arising from temperature variations and which generate a higher or lower output voltage than a conventional implementation.

2. Description of the Related Art

The ubiquitous "band-gap" principle finds widespread usage not only in voltage references for converters and other highly calibrated circuits, but also as the most convenient basis for simply setting up a bias (voltage or current) which is supply and temperature independent and of moderate accuracy. One such circuit in which the principle is applied is disclosed in U.S. Pat. No. 3,887,863 and U.S. Pat. No. Reissue 30,586 to Brokaw for a solid-state regulated voltage supply. Such circuits use forward-biased PN junctions operated at differing current densities; most usually, bipolar transistors having a reliable relationship between collector current ($I_C$) and base-emitter voltage ($V_{BE}$) are utilized.

The most common realization generates a loadable output voltage, usually some 65 mV greater than the so-called "band-gap voltage", which is referred to as $E_{GE}$ herein, corresponding to EG in SPICE. The e is added to $E_G$ to indicate that this is an effective or empirical quantity with the dimension of voltage. It is not a fundamental and directly-accessible physical constant, although it is closely related to the intrinsic zero-temperature band-gap energy of silicon. Such things as lattice strain, doping level and temperature all affect $E_{GE}$, which is best viewed as a process-dependent characterization parameter. It is determined by measuring $V_{BE}$ over a range of temperatures followed by curve-fitting. The well-known starting-point for $V_{BE}(T)$ is given in many texts as:

$$V_{BE}(T)=Vtln(Ic/AJs(T)) \qquad \text{Eq (1)}$$

where Vt=kT/q is the thermal voltage which equals 25.85 mV at 300 K., Ic is the collector current, A is the emitter area and Js(T) is the strongly temperature-dependent saturation current-density. This form, however, is not very satisfactory, because it doesn't explicitly include $E_{GE}$, it obscures the simple basic shape of $V_{BE}(T)$, and it is impractical to parametize. A more useful formulation, obtained by analytically using a comprehensive expression for Js(T), followed by a practical characterization procedure is:

$$V_{BE}(H)=E_{GE}-H(E_{GE}-V_{BER})+HVtr(ln(Ic/Ir)-m\ ln\ H) \qquad \text{Eq (2)}$$

where $V_{BER}$ is the $V_{BE}$ for a known collector current Ir and reference temperature Tr, Vtr is the value of Vt at this reference temperature, m is the exponent of temperature in the full expression for Js(T), which is called XTI in SPICE, and has a theoretical value of 3.5.

In Equation (2), H=T/Tr. This conveys the idea of relative "hotness" and avoids the needless repetition of quotient factors (T/Tr). Thus, H is 1 when the junction temperature is the same as the reference temperature; H is zero at absolute zero of temperature; and is roughly 2 in the extrapolated temperature region where $V_{BE}$ approaches to zero. The components of $V_{BE}(H)$ can be expressed as follows:

$$V_{BE}(H)=E_{GE}-H\{E_{GE}-V_{BER}-Vtr\ ln(Ic/Ir)\}-mVtrH\ ln\ H \qquad \text{Eq (2a)}$$

where the first term is a fixed voltage, the second term is a linearly-decreasing voltage and the third term represents the "curvature." To parametize the $V_{BE}$ expression, the device is operated at some moderate level of current, preferably but not necessarily at Ic=Ir, avoiding either low- or high-injection operating regions, and at some moderate value of collector bias, and $V_{BE}$ is measured over temperature, from which data $E_{GE}$ and m can be determined by nonlinear regression; typical values are $E_{GE}$=1.2 V and m=3.5.

Curvature

The last term in Equation (2) is a nuisance, since it usually sets a lower limit on the error which can be attained over some temperature range. The form of the basic function −HlnH is interesting. It is zero for H=0 and passes through zero again at H=1. The derivative of this term is −(1+lnH), so it reaches a peak value of $e^{-1}$ at $H=e^{-1}$. The slope as it passes through zero is −1. FIG. 1 shows the function −HlnH over the range $0 \leqq H \leqq 1.5$.

A reference temperature of Tr=300 K. is often used. Thus, in more practical terms, H might have values from about 220/300 (at T=−53° C.) to 400/300 (at T=127° C.). Furthermore, the linear part of HlnH is compensated by designing or trimming the circuit so that the reference output has (in effect) a small voltage which varies proportional to temperature added to the "ideal" value of $E_{GE}$. Since standard band-gap principles have been well covered in many prior discussions, this design detail need not be explained in length here. It can be shown, however, that the residual curvature has the functional form H (1−lnH)−1. If this is plotted over the practical range 220 K. to 400 K., the form is seen to be approximately parabolic, and the peak variation from 300 K. to 400 K. is −0.05, as shown in FIG. 2.

In Equation (2a) the term HlnH is multiplied by the factors m and Vtr. If m is assigned the theoretical value of 3.5 and with Vtr being 25.85 mV at Tr=300 K., the peak variation of −0.05×m×Vtr evaluates to about a −4.5 mV error at the upper end of the full military temperature range. It is apparent from FIG. 2 that a small adjustment to the linear term added to $E_{GE}$ could equalize the peak error at both the upper and lower ends of this range: it is readily shown that the peak voltage error can be reduced to −0.045 mVtr by this kind of centering.

To fully evaluate the peak curvature error in a practical circuit, one further aspect of Equation (2) should be noted. Within the linearly-decreasing component of the $V_{BE}(H)$, there is another potential parabolic term. This is because Ic is usually (but not necessarily) proportional to absolute temperature, so Ic/Ir has the form pH, where p would simply be unity if we chose to make Ic=Ir at T=Tr. This gives rise to what might be called "a unit of curvature" having a sign so as to reduce the "m units of curvature" arising in the final term of Equation (2) to (m−1) units.

Thus, in a typical prior art reference cell, the peak curvature error might have a value of −0.045×(3.5−1)×25.85 mV, or about −2.9 mV. Now, the general magnitude of the reference voltage which experiences this error is about 1.25 V, so the peak error over the full temperature range is −0.232%.

Many ideas have been presented to deal with this small but occasionally bothersome error in ICs which have a critical calibration over wide temperature ranges. Such prior art schemes are empirical and approximate, although in some designs the improvement is adequate. The novelty of the approach presented here is that it is fundamentally exact, extremely simple to implement and has the further advantage of utilizing less of the available supply voltage, that is, the optimal (zero-curvature) reference voltage so generated is typically about one-third of the usual value.

Practical Band-Gap Cells

The band-gap cell due to Brokaw is one of the most popular and versatile implementations of the underlying principles, although numerous alternative forms have been devised. In some realizations, the voltage $E_{GE}$ never appears explicitly, but the same principles are invoked to produce a current which is essentially supply and temperature independent. In other cases, a further $V_{BE}$ is added to the output to compensate for $V_{BE}$ of one or more transistors used in current sources; compensation for finite beta can also be added in such cases.

The Brokaw band-gap cell (disclosed in U.S. Pat. No. 3,887,863 and U.S. Pat. No. Reissue 30,586) has been well-documented in numerous places. By way of review, and to establish the framework of the present invention, FIG. 3 shows the most generalized circuit. In its simplest form, it consists of a combination of just two transistors Q1, Q2 and two resistors R1, R2 supported by a high-gain loop amplifier 10 which forces the current-density, J2, in Q2 to be substantially higher than the current-density, J1, in Q1, typically by the simple exedient of making the emitter area, A1, of Q1 much larger than the emitter area, A2, of Q2 while forcing their collector currents, I1 and I2, to be equal. Clearly, there are many possible arrangements; for example, the emitter area ratio could be unity and the current ratio I2/I1 made greater than unity or some combination of these.

The analysis begins by noting that there is a difference in the $V_{BE}$'s of Q1 and Q2:

$$\Delta V_{BE}=kT/q \ln \lambda \qquad \text{Eq (3)}$$

where $$\lambda=J2/J1=(A1/A2)(I2/I1) \qquad \text{Eq (4)}$$

Since k, q and λ are stable with temperature, the $\Delta V_{BE}$ is (in principle and very closely so in practice) precisely proportional to the absolute temperature, T: referred to herein as PTAT. Furthermore, since this voltage is forced across R1, the current in Q1 is simply:

$$I1=\Delta V_{BE}/R1 \qquad \text{Eq (5)}$$

The current in R2 is the sum of I1 and I2. It is assumed herein that the usual design conditions apply, namely, the currents in Q1 and Q2 are forced to be equal by the high-gain feedback amplifier 10 and the emitter area ratio A1/A2 is denoted more simply as just A (Q2 can be given a "unit" emitter area, often that of a minimum-geometry transistor). Under these conditions, A becomes identical to the λ of Equation (4). From here onward, the more familiar A will be used and the usual condition that I1=I2 will be assumed. Note that when values of λ>A are used, by making I1<I2, some of the design procedures outlined below will need modification. Now, it will be apparent that the voltage across R2 in FIG. 3 is:

$$V_{PTAT}=2(R2/R1)(kT/q)\ln A \qquad \text{Eq (6)}$$

$V_{OUT}$ is the sum of this voltage, which is PTAT, and the $V_{BE}$ of Q2, which may be called CTAT (complementary to absolute temperature), decreasing essentially linearly with temperature, as shown by the second term in Equation (2). By appropriate choice of the ratio R2/R1, the slopes of these two voltages can be rendered equal in magnitude and opposite in sign. Thus, $$V_{OUT}=V_{BE}(H)+2HVtr2/R1 \ln A \qquad \text{Eq (7a)}$$

$$=E_{GE}-H(E_{GE}-V_{BER})+HVtr(\ln(Ic/Ir)-m \ln H)+2\,HVtr2/R1 \ln A \qquad \text{Eq (7b)}$$

The completion of the analysis is straightforward and will not be given here. However, it is easily shown that in order to achieve zero first-order temperature-sensitivity, $V_{OUT}$ must have the unique value:

$$V_{BG}=E_{GE}+(m-1)Vtr \qquad \text{Eq (8)}$$

where Vtr is the value of kT/q at the temperature for which the first-order slope is to be nulled. In the examples herein, $E_{GE}$=1.2 V and m=3.5. Thus, to null the slope at T=300 K., where Vtr= 25.85 mV, requires $V_{OUT}$=1.265 V, that is, 65 mV greater than the "band-gap voltage".

Note that this result does not depend on any knowledge of $V_{BER}$ or the area ratio A. Of course, the condition expressed in Equation (8) cannot be fully guaranteed by design alone, since the particular values of $V_{BER}$ and A will affect the required values of R1 and R2, which may need to be adjusted in some way, sometimes using laser-trimming to result in $dV_{OUT}/dT=0$ at T=Tr; however, as noted above, the curvature error arises whenever T varies over a wide range.

SUMMARY OF THE INVENTION

In one aspect, the present invention comprises a band gap reference device in which first and second transistors have the bases thereof coupled together. A first supply voltage line is operatively connected to the collectors of the transistors and a second supply voltage line is operatively connected to the emitters of the transistors. The voltage supply lines produce a current proportional to temperature when the device is operating. A resistor is placed between the emitter of one of the transistors and the second supply line. A third transistor has the base thereof coupled to the bases of said first and second transistors. A current is established in a load resistor which is equal to the sum of the currents in said first and second transistors less a nonlinear portion which arises from variations in $V_{BE}$ with respect to temperature.

In another aspect, a band gap reference device is provided in which first and second transistors have the bases thereof coupled together. A first supply voltage line is operatively connected to the collectors of the transistors and a second supply voltage line is operatively connected to the emitters of the transistors. The voltage supply lines produce a current proportional to temperature when the device is operating. A resistor is operatively disposed across the base-emitter junction of one of the transistors. A current complementary to temperature is established in the resistor when the device is operating. The currents in the transistors and in the resistor are combined to produce a reference current having a predetermined temperature coefficient characteristic.

It is a general object of the present invention to provide a band gap reference cell which overcomes the above-enumerated disadvantages associated with prior art circuits.

It is another object of the present invention to provide such a cell which precisely and fundamentally compensates for the curvature inherent in prior art cells.

It is another object of the present invention to provide such a cell which establishes a voltage reference greater than the effective band gap voltage.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENTS

Figure 1:
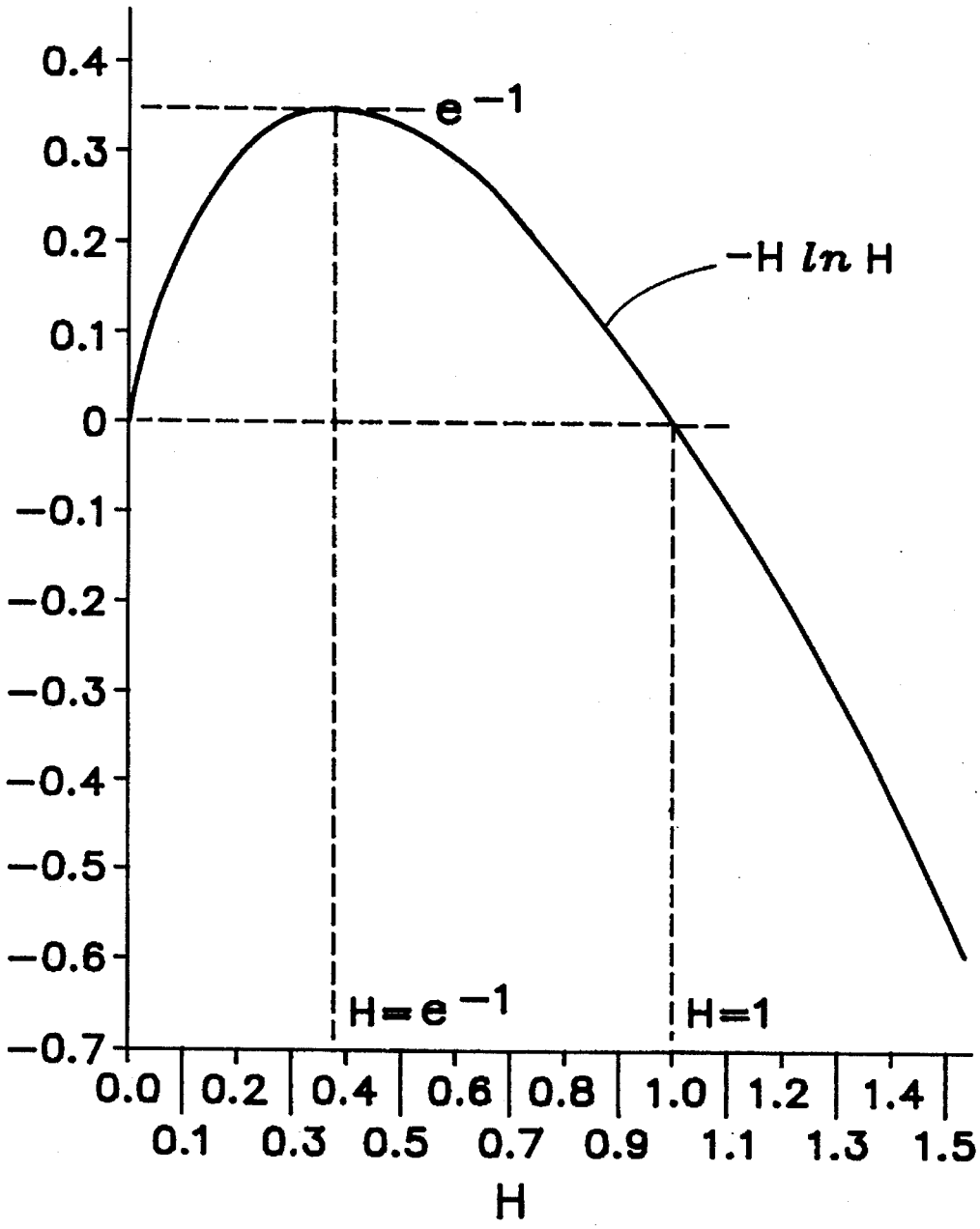
FIG. 1 is a plot of –HlnH, the curvature function in $V_{BE}$, down to absolute zero.
Figure 2:
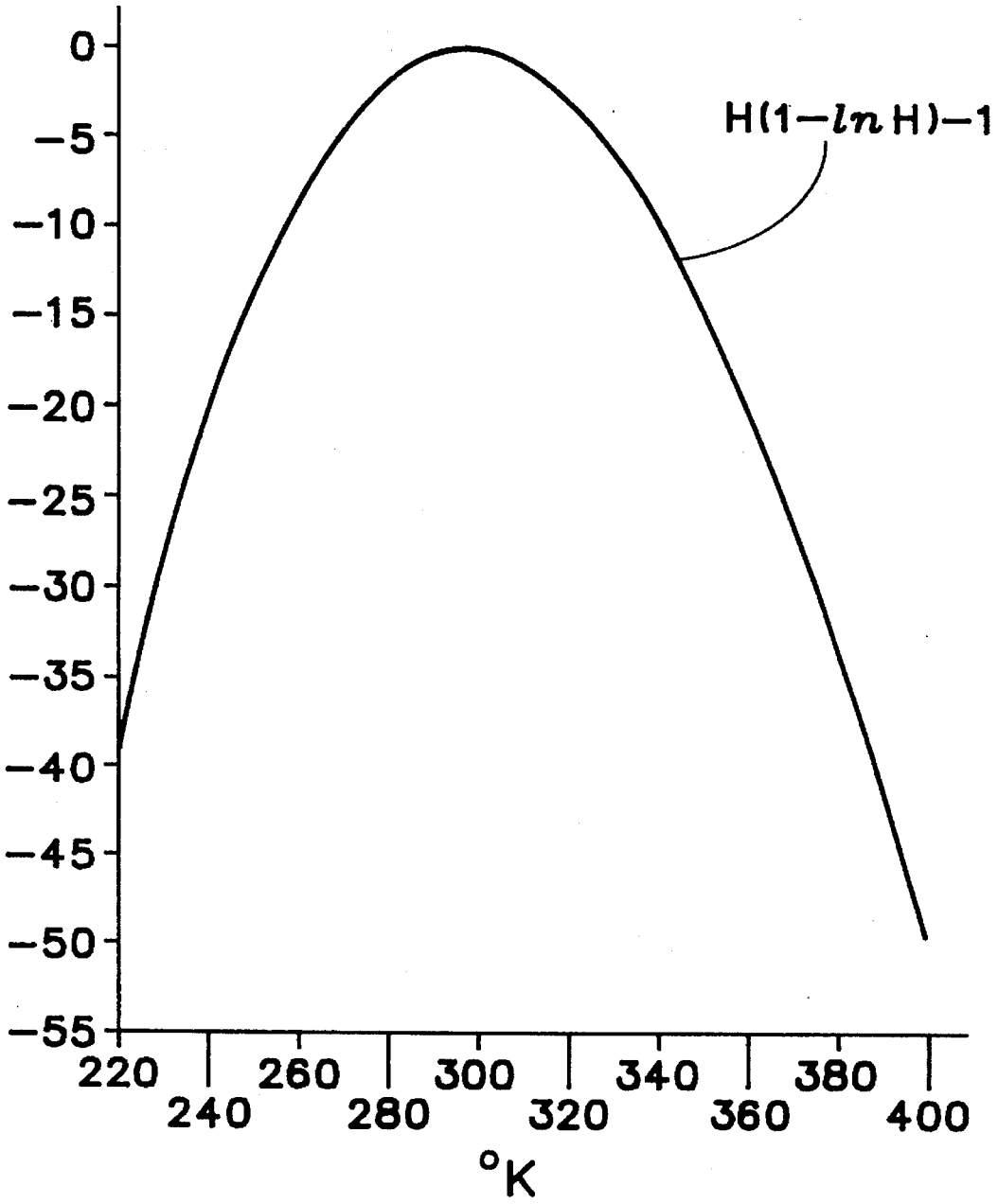
FIG. 2 is a plot of H (1–lnH)–1, the residual curvature function in $V_{BE}$, over the full military specified temperature range.
Figure 3:
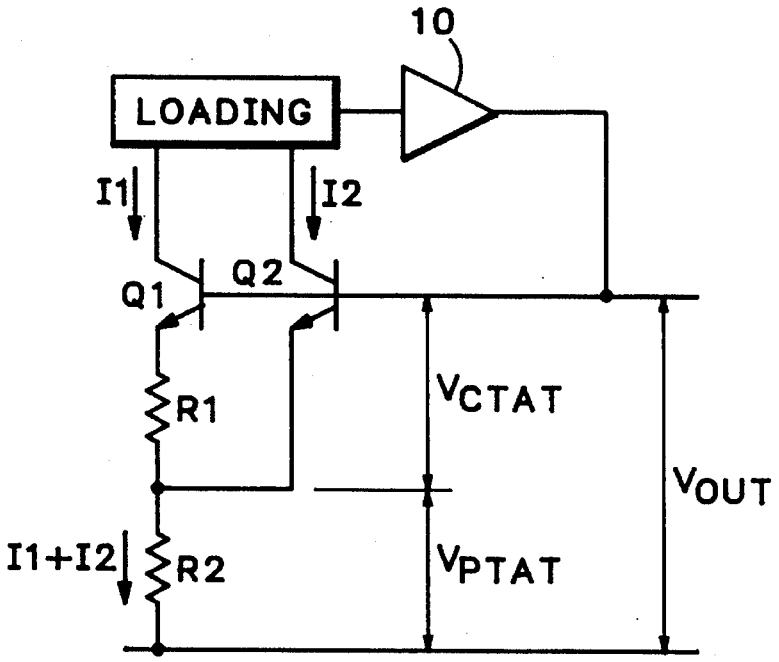
Fig. 3 PRIOR ART
FIG. 3 is a simplified schematic of a prior art Brokaw reference cell.
Figure 4:
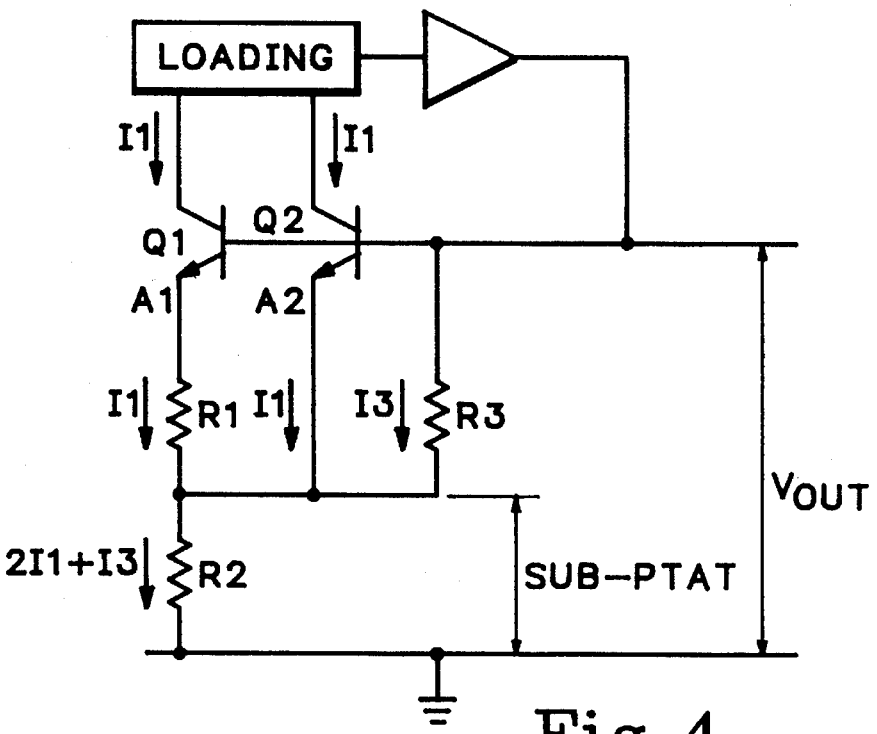
FIG. 4 is a simplified schematic of a stable reference cell constructed in accordance with the present invention which produces a stable reference voltage greater than the effective band gap voltage.

Turning now to FIG. 4, indicated generally at 12 is a circuit which generates a temperature-stable output voltage, $V_{OUT}$, greater than $E_{GE}$. A resistor R3 is placed across the base-emitter junction of Q2. Since the current in this resistor is CTAT (complementary to absolute temperature), the voltage across R2 is now sub-PTAT, meaning that the variation in this voltage in the operating temperature range is less than would be the case for a PTAT voltage. To properly compensate the reduction of $V_{BE}$ with temperature the magnitude of this voltage must now be higher than would be the case if it were PTAT. Any voltage higher than $E_{GE}$ can be generated in this way.

In analyzing circuit 12, note that the $V_{BE}$ of both Q1 and Q2 is once again completely defined, being unaffected by the presence of R3. Second, note that the effect of R3 is merely to raise the voltage across R2 by the amount $V_{BE}$(H)R2/R3. Thus:

$$V_{OUT}=(1+R2/R3)V_{BE}(H)+(2HVtrR2/R1)\ln A \qquad \text{Eq (12)}$$

Let Z=(1+R2/R3). Then:

$$V_{OUT}=Z\{V_{BE}(H)+(2HVtrR2/ZR1)\ln A\} \qquad \text{Eq (13)}$$

The portion of Equation 13 inside the braces has the same form as Equation (7a) for the basic band-gap. The only difference is the occurrence of the factor Z which alters the required value of R2 to achieve a desired output voltage. Thus, the same essentials apply, with the result that for the same zero-first-order TC we must ensure that:

$$V_{OUT}=ZV_{BG}=Z\{E_{GE}+(m-1)Vtr\} \qquad \text{Eq (14)}$$

Design Procedure for the "Super-EG" Band-Gap

1. From a presumed-known $E_{GE}$ and m, determine $V_{BG}$
2. Choose $Z=V_{OUT}/V_{BG}$
3. Choose a suitable value for A
4. Choose a desired Ic at Tr, and then calculate R1 using Equation (10)
5. Calculate R2o, the value R2 would have if Z=1, using Equation (11a) or (11b); note that this step requires a knowledge of $V_{BER}$
6. Calculate the modified value for R2=Z R2o
7. Calculate the required value of R3=R2/(Z–1)

For example, to generate a stable value of 2.5 V at $V_{OUT}$ for a process in which $E_{GE}$=1.2 V and m=3.5, the stone idealized values used earlier, the following steps are performed:

1. $V_{BG}$=1.2 V +(3.5–1)×25.85 mV=1.2646 V for zero TC at T–300 K.
2. Z=2.5/1.265=1.977
3. Choose A=10
4. Choose Ic=100=μA; then R1=(26 mV ln 10)/100 μA=595.22 Ω. At this point R1 can be rounded off to some convenient value; the only significant consequence is that R2 and R3 ratio accordingly. Let R2=600 Ω
5. Assuming $V_{BER}$=600 mV at Ic=100 μA, Tr=300 K., then R2o evaluates to 5.583× 600 Ω=3.35 kΩ. This is the value R2 should have for the basic band-gap circuit.
6. Calculate R2=1.977×3.35 kΩ=6.623 kΩ
7. Calculate R3=6.623 kΩ(1.977–1)=6.779 kΩ

Figure 5:
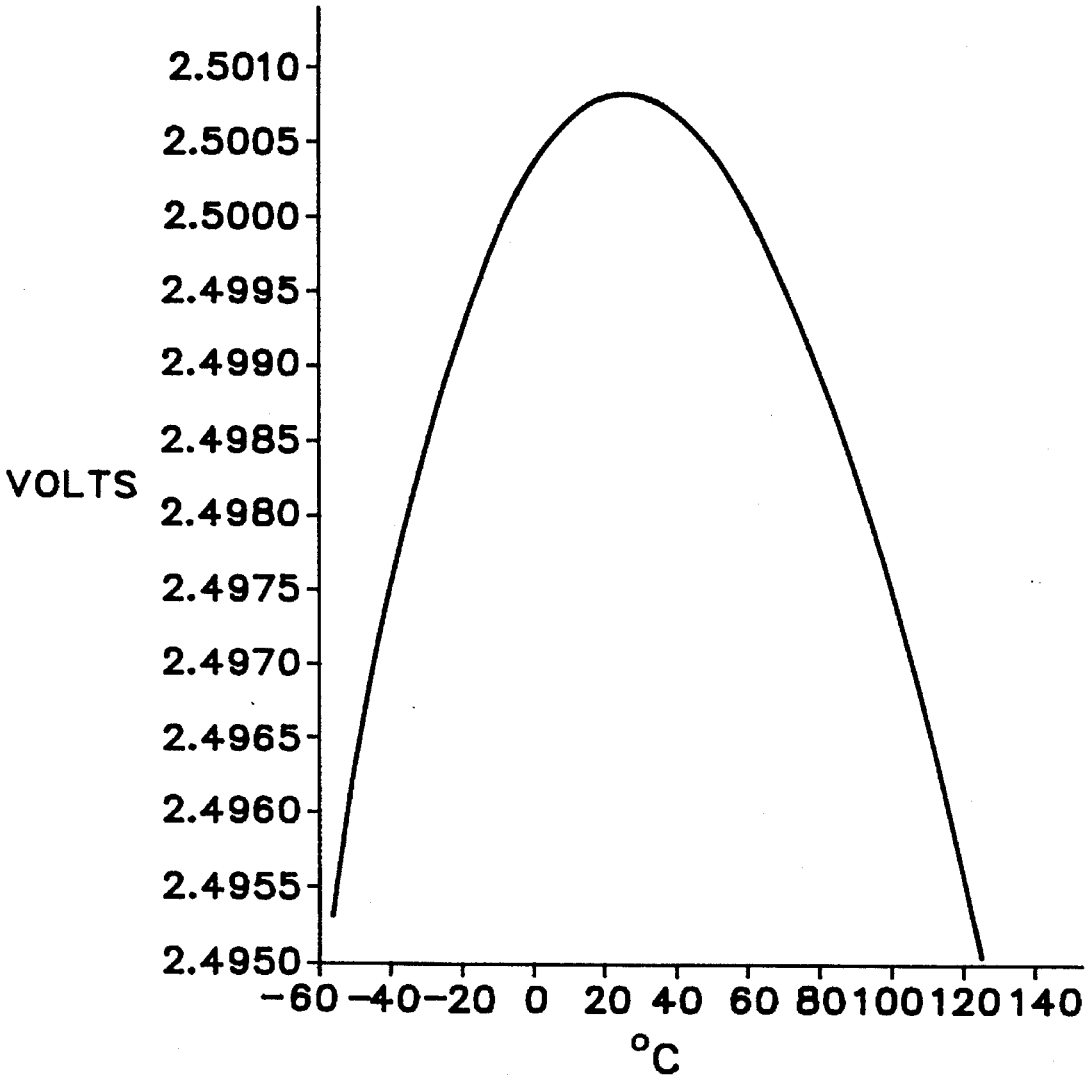
FIG. 5 is a plot of the reference voltage generated by the circuit of FIG. 4, in which curvature remains.

The closeness in the values of R2 and R3 in this example is only fortuitous. The simulated result is shown in FIG. 5, which validates the correctness of the design procedure. There is a prior art method of generating super-$E_{GE}$ voltages which involves inserting a voltage attenuator in the feedback path from the output to the common base node of the band-gap pair. There are a few subtle differences, and there may prove to be some cases where this approach has advantages. Note that the absolute curvature magnitude increases in simple proportion to the multiplication factor Z, so the relative curvature of $V_{OUT}$ remains unchanged regardless of its magnitude.

Note something interesting: combining steps (6) and (7), it is apparent that the required value of R3=R2o Z/(Z–1), so for very large values of Z, R3 becomes asymptotic to R2o which is nothing more than the value required for R2 in the basic band-gap cell. With this value for R3, the current in R2 is constant with temperature, at least, almost constant—there remains the same fractional curvature component as before.

Still, this provides a design scheme which uses this unique condition to realize a driver for the bias line of a set of current sources, where any desired and arbitrary voltage across R2 can be selected. For example, 500 mV is considerably less than a "band-gap" while still providing sufficient potential to afford ample protection against $V_{BE}$ mismatches in the current-source transistors and provide almost asymptotic output resistance in the presence of finite early voltage.

A Zero-Curvature Band Gap Cell

In realizing one or more BJT current sources within an IC it is common to use emitter degeneration resistors to increase the output resistance, reduce noise, reduce errors due to $V_{BE}$ mismatches and ground-line error voltages, etc. A scheme, therefore, like that shown in FIG. 6 could be used where only one of the current-source cells is shown, but of course, any number could be driven by the presumed ideal op-amp 12 of FIG. 6 without altering the theory.

As will be recalled, it is an object of this scheme to provide currents which are supply and temperature independent. The voltage across R2, which can be rendered essentially stable over temperature by choosing R3=R2o, is transferred to the emitter resistor Rx. We know that the current densities in Q2 and Qx must be similar to avoid introducing a $V_{BE}$ mismatch. But closer inspection reveals that this "mismatch," actually another $\Delta V_{BE}$, can be advantageous.

Assume that Ix really is supply and temperature independent. Then the form of this $\Delta V_{BE}$ is just like the curvature component, because it is:

$$\Delta V_{BE}=Vt\ ln\ IcAx/IxA2 \qquad \text{Eq (15)}$$

where A2 is the emitter area of Q2 and Ax is the emitter area of Qx. Because IcAx/IxA2 can be given the form γH, where γ is a constant, and Vt has the form HVtr, Equation (15) can be rewritten, as follows:

$$\Delta V_{BE}=Vtr\ H\ ln\ H \qquad \text{Eq (16)}$$

Vx can be chosen to have just the right magnitude so that these curvature components exactly cancel.

Full Analysis of the Zero-Curvature Circuit

Figure 6:
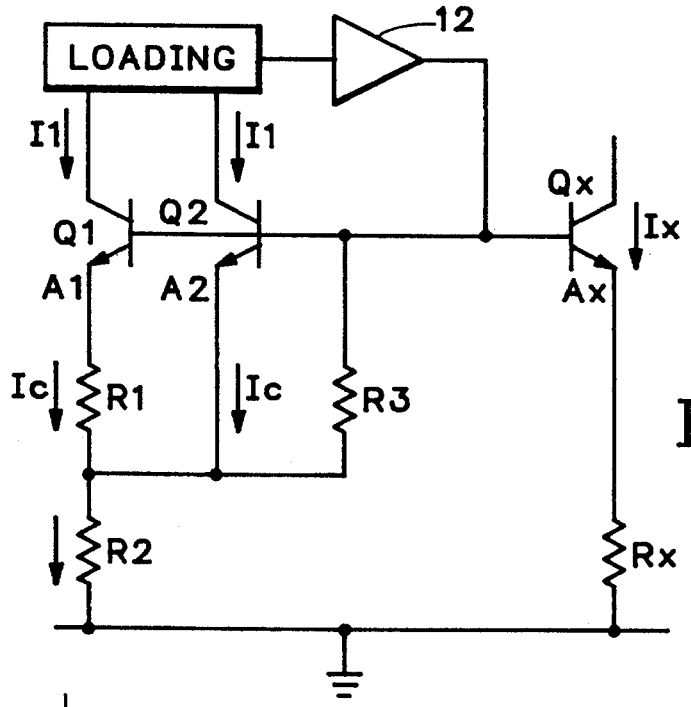
FIG. 6 is a simplified schematic of a reference cell constructed in accordance with the present invention which compensates for the curvature arising from variations in $V_{BE}$ with respect to temperature.

Analysis of the circuit of FIG. 6 begins with the same ingredients as used in the previous analyses, and incorporates the two latest parameters: the desired current Ix, which we is presumed to be stable over temperature, and some emitter area Ax.

Begin by observing that:

$$Vx=V_{OUT}-V_{BEX}(H) \qquad \text{Eq (17)}$$

Thus, borrowing Equation (12):

$$Vx=(1+R2/R3)V_{BE2}(H)+(2HVtrR2/R1)ln\ A-V_{BEX}\ (H) \qquad \text{Eq (18)}$$

Note that while the $V_{BE}$'s of Q2 and Qx have very similar forms, they must be treated separately because of the possibility of different current densities (even at T=Tr) and also because Q2 is operating PTAT while Qx is operating independently of supply voltage and temperature. Equation 18 can be rewritten, with each of the three terms appearing on a separate line, as follows:

$$\begin{aligned} Vx = (1 + R2/R3)\{E_{GE} - H\{E_{GE} - V_{BER} - \\ Vtr(\ln Ic/Ir - m\ln H\}\} + (2HVtrR2/R1)\ \ln A - \\ \{E_{GE} - H\{E_{GE} - Vber - Vtr(\ln IxA2/IrAx - m\ \ln H\}\} \end{aligned} \qquad \text{Eq (18a)}$$

As before, assume that Ic=Ir at T=Tr, and elsewhere Ic is PTAT. Thus, the ln Ic/Ir term in the first line of Equation (18a) simply becomes ln H. Equation (18a) can be rewritten to place on the first line a term which is constant with temperature, on the second line a term which is linear with temperature (or, hotness, H) and on the third line a term which has a higher-order dependence:

$$\begin{aligned} Vx = (R2/R3)E_{GE} + H\{Vtr\{2R2/R1\ \ln A - \ln IxA2/IrAx\} - \\ (E_{GE} - V_{BER})(R2/R3)\} - (H\ln H\ Vtr[(1 + R2/R3)(m - 1) - m] \end{aligned} \qquad \text{Eq (18b)}$$

The objective is to find the condition for which both the first and second-order derivatives are zero. This is easily done, but an equivalent approach is to simply null the H and H ln H terms independently. The latter yields:

$$R2/R3=1/(m-1) \qquad \text{Eq (19)}$$

Therefore, the value of Vx for zero curvature, quite independent of the other condition for zero linear temperature dependence, is given by:

$$Vx = (R2/R3)E_{GE} = \frac{E_{GE}}{m-1} \qquad \text{Eq (20)}$$

For the typical values $E_{GE}$=1.2 V and m=3.5 the zero curvature voltage for Vx is:

1.2 V/2.5=480 mV an ideal value for contemporary single-supply 3 V and 5 V circuits.

The condition for zero linear terms is, from Equation (18b), with some slight manipulation:

$$2R2/R1\ ln\ A-ln\ IxA2/IrAx=(E_{GE}-V_{BER})/(Vtr(m-1)).$$

Obviously, this can be solved for various unknowns, but most likely we will know the desired value of Ix, have made some choices about Ax (appropriate to the size of Ix), A2 is most likely the "unit" emitter, Ir is known, A can be chosen as previously described, and R1 will be chosen to set Ic to Ir at T=Tr. This just leaves R2, which must have the value:

$$R2 = R1\left\{\frac{E_{GE} - V_{BER}}{Vtr(m-1)} + \ln\frac{IxA2}{IrAx}\right\}\frac{1}{2\ln A} \qquad \text{Eq (21)}$$

Finally, we can readily choose Ax to be exactly A2 Ix/Ir, in which case the log term vanishes and noting as before that R1=(Vtr ln A)/Ir:

$$R2 = \frac{E_{GE} - V_{BER}}{2(m-1)Ir} \qquad \text{Eq (22)}$$

and therefore:

$$R3 = R2(m-1) = \frac{E_{GE} - V_{BER}}{2Ir} \qquad \text{Eq (23)}$$

AN EXAMPLE

Because of the very high precision which this circuit promises, care should be taken in the use of near-exact values in the calculations and subsequent validation through simulation. Let A=10 and R1=595.22 Ω to set Ic=100 μA at Tr=300 K., and let $V_{BER}$=600 mV for these conditions (requiring IS in SPICE to be 8.5 E−15). Let Ix also be 500 μA, and therefore choose Ax= 5×A2 in order to make the log term in Equation (21) vanish. Vx is known to be 480 mV, so Rx evaluates to 960 Ω. Using Equations (22) and (23), R2 is calculated to be 1.2000 kΩ and R3 to be 3 kΩ.

Figure 7:
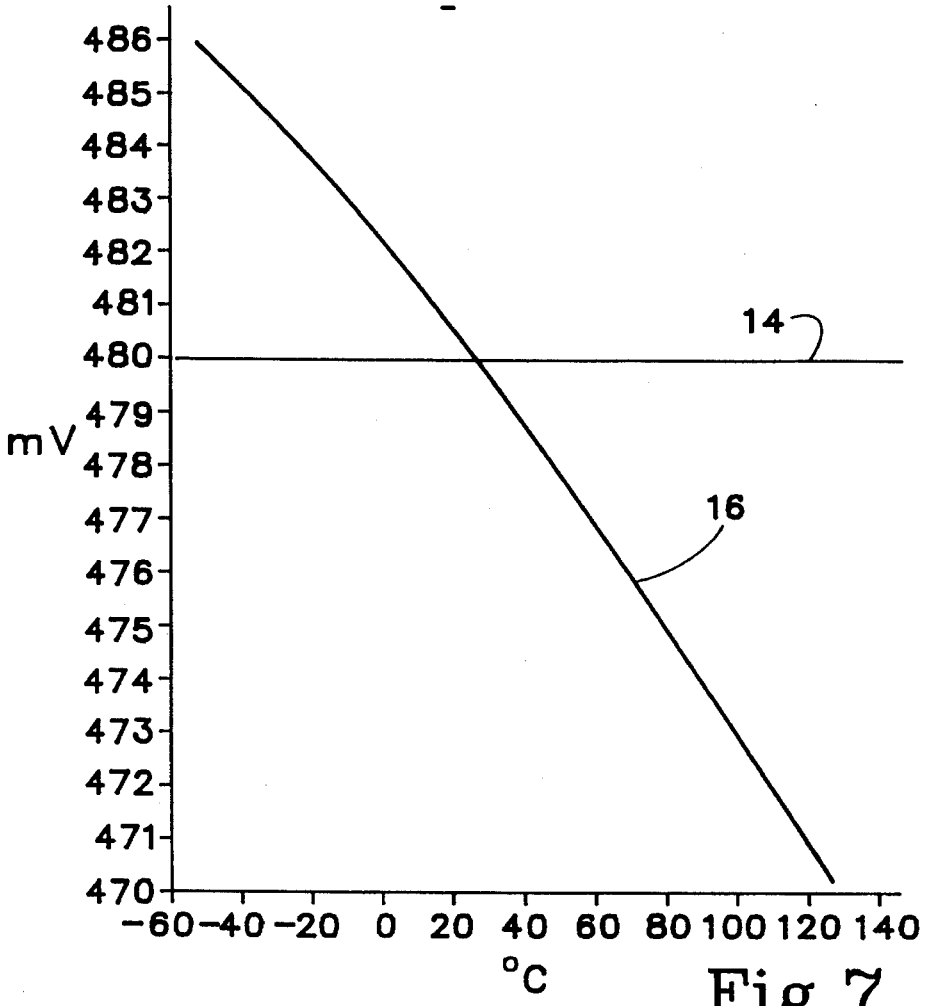
FIG. 7 is a plot illustrating how the reference voltage and the voltage across R2 vary with temperature in the cell of FIG. 6.

The prediction made with Equation (20) above that Vx will be 480 mV is accurate. Using transistors having idealized parameters BF=10,000, BR=10,000, VAF=10,000, and VAR=10,000, the simulation shows essentially perfect agreement as set forth in FIG. 7 in which curve 14 is a plot of Vx indicating no variation with change in temperature and curve 16 is a plot of the voltage across R2 indicating a large negative T.C. (about −185 ppm/°C.) and a slight curvature as temperature varies.

An Implemented Circuit

Figure 8:
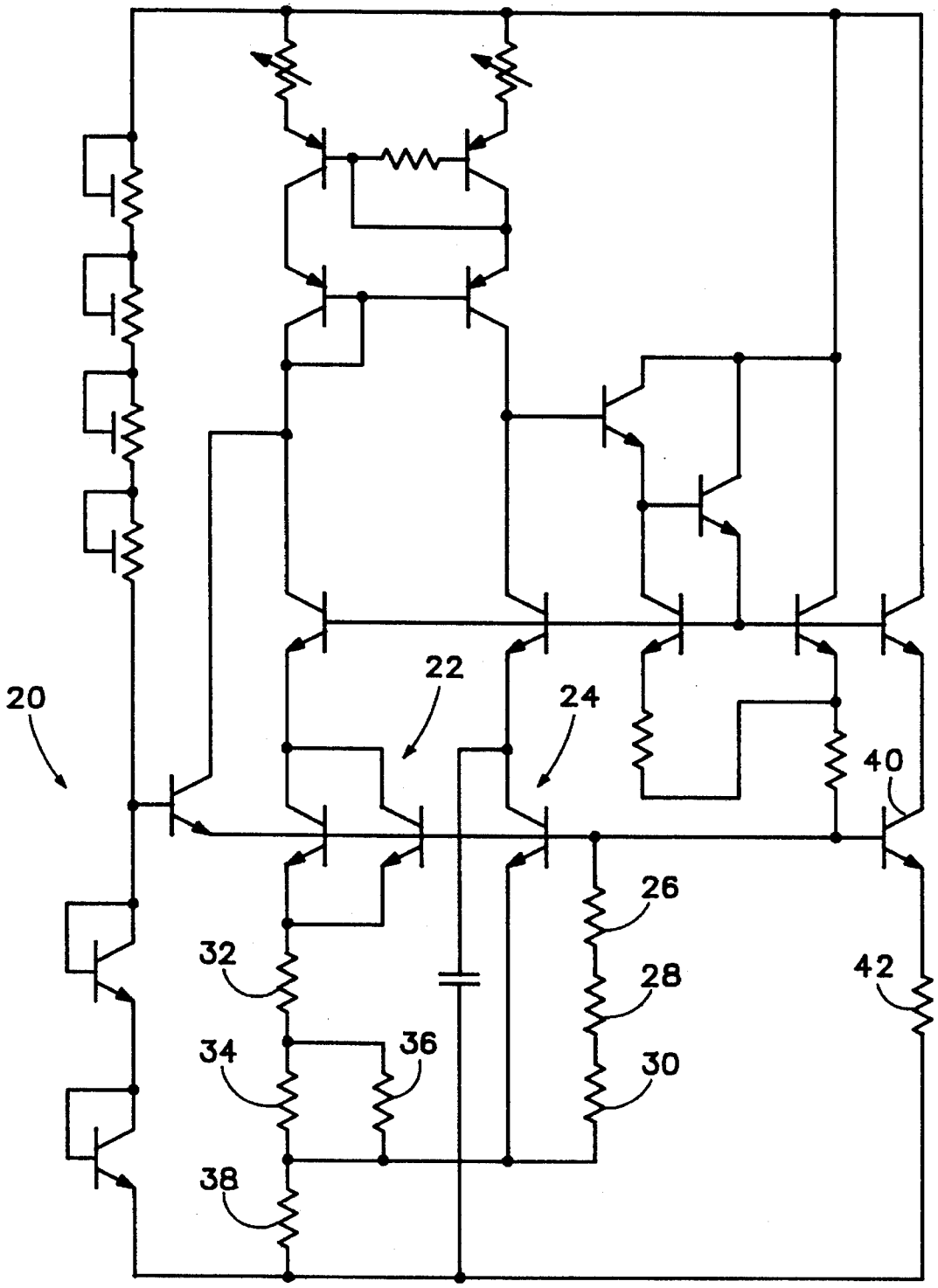
FIG. 8 is a schematic of a circuit for generating a reference voltage which incorporates the cell of FIG. 6.

Turning now to FIG. 8, indicated generally at 20 is a circuit which has been built and implemented in monolithic form as a practical integrated circuit. Included therein is a zero-curvature band-gap reference cell constructed in accordance with the present invention. The band-gap cell in circuit 20 includes repeated transistor 22, which corresponds in function to Q1 in FIG. 6, and a transistor 24, which corresponds in function to transistor Q2 in FIG. 6. A plurality of resistors 28–38 are formed as indicated in circuit 20. In the embodiment of circuit 20, each resistor has a value of 350 ohms. In FIG. 8, resistors 32, 34, 36 correspond to R1 in FIG. 6, resistors 26, 28, 30 correspond to R3 in FIG. 6 and resistor 38 corresponds to R2 in FIG. 6.

A transistor 40 and a resistor 42 correspond to transistor $Q_x$ and resistor $R_x$, respectively, in FIG. 6. In the embodiment of FIG. 8, 367 mV appear across resistor 38. This voltage exhibits a slight curve, as discussed above, with variations in absolute temperature. In the circuit of FIG. 8, $E_{GE}$=1.144 and m=3.98. Using equation 20, the value of the voltage across resistor 42 is found to be 388 mV with this value being extremely constant with variation in absolute temperature described above.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

I claim:

1. A band gap reference device comprising:

first and second transistors having their bases coupled together;

first and second supply voltage lines, said first line being operatively connected to the collectors of said transistors and said second line being operatively connected to the emitters of said transistors, said supply voltage lines producing a base-emitter voltage in each transistor that varies both linearly and non-linearly according to temperature when said device is in operative condition;

a resistor connected between the emitter of one of said transistors and the second supply voltage line, a temperature dependent voltage being established across said resistor when said device is in operative condition; and means for producing a given reference voltage that remains substantially constant with both linear and non-linear changes in the base-emitter voltages of said first and second transistors.

2. The band gap reference device of claim 1 in which the base-emitter voltage of the second transistor in combination with the voltage across the resistor defines an output voltage proportional to $E_{GE}+(m-1)V_{TR}$ where $E_{GE}$ is the effective band gap voltage, m is the temperature exponent of saturation current and $V_{TR}$ the thermal voltage at a given reference temperature.

3. The band gap reference device of claim 2 in which the resistor is defined as a first resistor and said device further includes a second resistor coupled across the base emitter junction of one of said transistors, the first, and second resistors sized so that the output voltage is equal to $[1+R1/R2][E_{GE}+(m-1)V_{tr}]$ where R1 is the value of the first resistor and R2 is the value of the second resistor.

4. The band gap reference device of claim 1 wherein said device further includes output circuit means connected to the base of one of said transistors for developing the reference voltage at an output terminal, the reference voltage proportional to the voltage across said first resistor combined serially with the $V_{BE}$ voltage of said second transistor.

5. The band gap reference device of claim 1 wherein said device further includes:

a third transistor having the base thereof coupled to the bases of said first and second transistors; and a curve-compensation resistor operatively disposed between the emitter of said third transistor and said second supply voltage line to produce a correction voltage relative to said second transistor which exactly compensates for residual curvature in said output voltage resulting from the $V_{BE}$ component of said first and second transistors.

6. The band gap reference device of claim 1 wherein said device further includes means for establishing different current densities in said two transistors so that a ratio between the current densities is set at a predetermined value.

7. The band gap reference device of claim 1 wherein said device further includes:

a third transistor having the base thereof coupled to the bases of said first and second transistors; and a curve-compensation resistor operatively disposed between the emitter of said third transistor and said second supply voltage line for establishing a voltage equal to said output voltage less a nonlinear portion thereof which arises from variations in $V_{BE}$ of said third transistor with respect to temperature.

8. A method for establishing a band gap reference voltage having a level greater than the effective band gap voltage comprising the steps of:

coupling the bases of a pair of transistors together;

establishing currents through said transistors which vary both linearly and non-linearly according to temperature;

connecting a first resistor between the base and emitter of one of said transistors;

establishing a current in said first resistor which varies complementary to temperature;

establishing a current flow in a second resistor equal to the sum of the currents in said transistors and said first resistor; and producing a reference voltage proportional to the voltage across said second resistor combined serially with the $V_{BE}$ voltage of one of said transistors at a reference voltage output terminal, the reference voltage remaining substantially constant for both linear and non-linear variances in the transistor currents.

9. The method of claim 8 wherein said method further comprises the step of establishing different current densities in said two transistors so that a ratio between the current densities is set at a predetermined value.

10. The method of claim 8 wherein said method further comprises the step of establishing a current in a third transistor which is equal to said reference current less a nonlinear portion thereof which arises from variations in $V_{BE}$ with respect to temperature.

11. A band gap reference device comprising:

first and second transistors having their bases coupled together;

first and second supply voltage lines, said first line being operatively connected to the collectors of said transistors and said second line being operatively connected to the emitters of said transistors, said supply voltage lines producing a current proportional to temperature in said transistors when said device is in operative condition;

a resistor operatively disposed between the emitter of one of said transistors and said second voltage supply line; and means for applying a voltage across said resistor which is equal to $E_{GE}/(m-1)$ where $E_{GE}$ is the effective band gap voltage and m is the exponent of temperature in equation for saturation current density of a transistor.

12. The band gap reference device of claim 11 wherein m=3.5.

13. The band gap reference device of claim 11 wherein said means for applying a voltage across said resistor which is equal to $E_{GE}/(m-1)$ comprises:

a third transistor having the base thereof coupled to the bases of said first and second transistors; and a curve-compensation resistor operatively disposed between the emitter of said third transistor and said second supply voltage line for establishing a current in said transistor which is equal to the sum of the currents in said first and second transistors less a nonlinear portion thereof which arises from variations in $V_{BE}$ of said third transistor with respect to temperature.

14. A band gap reference device comprising:

first and second transistors having their bases coupled together;

first and second supply voltage lines, said first line being operatively connected to the collectors of said transistors and said second line being operatively connected to the emitters of said transistors, said supply voltage lines producing a current proportional to temperature in said transistors when said device is in operative condition;

a resistor operatively disposed between the emitter of one of said transistors and said second voltage supply line;

a third transistor having the base thereof coupled to the bases of said first and second transistors;

a curve-compensation resistor operatively disposed between the emitter of said third transistor and said second supply voltage line for establishing a current in said third transistor which is equal to the sum of the currents in said first and second transistors less a nonlinear portion thereof which arises from variations in $V_{BE}$ in each third transistor with respect to temperature; and each resistor sized so that the current in said third transistor establishes a voltage across the curve-compensation resistor having a zero first-order temperature sensitivity.

15. A method for establishing a band gap reference voltage for a circuit having first, second and third transistors having their bases coupled together; first and second supply voltage lines, said first line being operatively connected to the collectors of said transistors and said second line being operatively connected to the emitters of said transistors; a first resistor disposed between the emitters of said first and second transistors; a second resistor disposed between the emitter of said second transistor and said second voltage supply line; and a third resistor disposed between the emitter of the third transistor and said second voltage supply line; comprising the steps of:

determining a voltage $V_{BG}$ equal to $E_{GE}+(m-1)V_{TR}$ where $E_{GE}$ is the effective band-gap voltage, m is the temperature exponent of saturation current, and $V_{TR}$ is the thermal voltage at a given reference temperature;

selecting a factor Z that is equal to $V_{OUT}/V_{BG}$ where $V_{OUT}$ is a preselected output voltage;

determining a value for the first resistor equal to $(V_{TR})$ (ln A)$I_C$ where A is a predetermined emitter area and $I_C$ is a predetermined collector current at the given reference temperature;

calculating a value for the second resistor $R_2$ equal to $[(Z)(V_{TR})2I_C][\{(E_{GE}- V_{BER})/V_{TR}\}+(m-1\}]$ where $V_{BER}$ is the base-emitter voltage at the given reference temperature; and selecting the value for the third resistor equal to $R_2/(Z-1)$.

* * * * *

UNITED STATES PATENT AND TRADEMARK OFFICE

CERTIFICATE OF CORRECTION

PATENT NO. : 5,519,308
DATED : May 21, 1996
INVENTOR(S) : Gilbert

It is certified that error appears in the above-indentified patent and that said Letters Patent is hereby corrected as shown below:

Column 6, line 15, change "stone" to --same--;
Column 6, line 31, change "kΩ(1.977-1)" to --kΩ/(1.977-1)--;
Column 11, Claim 13, line 8, change "said resistor" to --said third resistor--.

Signed and Sealed this

Tenth Day of March, 1998

Bruce Lehman

*Attest:*

BRUCE LEHMAN

*Attesting Officer*

*Commissioner of Patents and Trademarks*